US010076000B2

(12) United States Patent
Schjerven, Sr. et al.

(10) Patent No.: US 10,076,000 B2
(45) Date of Patent: Sep. 11, 2018

(54) CONTROL OF COOKING APPLIANCE IN RESPONSE TO CONTROL-COMPARTMENT, COOLING FAN FAILURE

(71) Applicant: The Middleby Corporation, Elgin, IL (US)

(72) Inventors: William S. Schjerven, Sr., Schaumburg, IL (US); Theodore James Chmiola, Roscoe (IL); Richard H. Van Camp, Aurora, IL (US)

(73) Assignee: THE MIDDLEBY CORPORATION, Elgin, IL (US)

( * ) Notice: Subject to any disclaimer, the term of this patent is extended or adjusted under 35 U.S.C. 154(b) by 756 days.

(21) Appl. No.: 13/722,695

(22) Filed: Dec. 20, 2012

(65) Prior Publication Data

US 2014/0175079 A1 Jun. 26, 2014

(51) Int. Cl.

| | |
|---|---|
| ***H05B 1/00*** | (2006.01) |
| ***H05B 3/00*** | (2006.01) |
| ***H05B 1/02*** | (2006.01) |

(52) U.S. Cl.

CPC ..... *H05B 1/0263* (2013.01)

(58) Field of Classification Search

CPC ..... H05B 1/0263; H05B 1/00; H05B 3/00; H05B 11/00; H05B 1/02; A21B 1/00; A21B 1/40; A21B 1/22; H02H 5/04

USPC ..... 219/209, 702, 715, 716, 391, 482, 490, 219/509, 412, 413; 324/164; 361/23, 24; D10/98

See application file for complete search history.

(56) References Cited

U.S. PATENT DOCUMENTS

| | | | | |
|---|---|---|---|---|
| 6,344,636 | B1 * | 2/2002 | Kim | 219/702 |
| 7,536,124 | B2 | 5/2009 | Yoshimoto | |
| 7,999,689 | B1 | 8/2011 | Ray et al. | |
| 2003/0042248 | A1 * | 3/2003 | Witt et al. | 219/497 |
| 2004/0089648 | A1 * | 5/2004 | Griffey et al. | 219/400 |
| 2007/0284361 | A1 | 12/2007 | Nadjafizadeh et al. | |
| 2010/0008006 | A1 | 1/2010 | Satoru et al. | |

(Continued)

FOREIGN PATENT DOCUMENTS

| | | |
|---|---|---|
| EP | 1093321 A3 | 3/2005 |
| EP | 1093321 B1 | 5/2011 |

(Continued)

*Primary Examiner* — Michael G Hoang

(74) *Attorney, Agent, or Firm* — Michael Best & Friedrich LLP

(57) ABSTRACT

A control system for a control-compartment cooling fan of an oven. In one embodiment, the control system includes a sensor for sensing an operating condition of a motor of the cooling fan. The operating condition is selected from the group of a motor current and a motor RPM. A controller is communicatively connected to the sensor and is configured to receive the operating condition from the sensor, compare the operating condition to one or more predetermined tolerances and, when the operating condition exceed at least one of the one or more predetermined tolerances, generate an interrupt command. A heating control element is communicatively connected to the controller and configured to interrupt operation of a heating element in response to receiving the interrupt command. The control system may also include a user interface communicatively connected to the controller.

7 Claims, 5 Drawing Sheets

(56) References Cited

U.S. PATENT DOCUMENTS

| | | | |
|---|---|---|---|
| 2010/0193503 | A1 | 8/2010 | Kim et al. |
| 2012/0115093 | A1 | 5/2012 | Yamashita et al. |
| 2012/0132635 | A1 | 5/2012 | Mishra |

FOREIGN PATENT DOCUMENTS

| | | | |
|---|---|---|---|
| EP | 2189734 | A3 | 6/2011 |
| WO | 2007136268 | | 11/2007 |
| WO | 2010116306 | | 10/2010 |

* cited by examiner

CONTROL OF COOKING APPLIANCE IN RESPONSE TO CONTROL-COMPARTMENT, COOLING FAN FAILURE

BACKGROUND

The present invention relates to ovens and similar cooking appliances. In particular, embodiments of the invention relate to control of a cooking appliance (hereafter generically referred to as an "oven") when a cooling fan for a control compartment fails.

SUMMARY

When an oven operates, it heats the food or other items within it. Of course, it is difficult and expensive to contain that heat. Therefore, most ovens give off heat into the surrounding environment. In many ovens, control electronics and other devices are placed in a housing or compartment which is located outside of the heating chamber of the oven. Nonetheless, the heat generated by the oven will cause the temperature in the control compartment to rise. As a consequence, such compartments are fitted with cooling fans whose purpose is to maintain the temperature of the control compartment within acceptable limits. An excessively high temperature in the control compartment can cause the control devices located within the compartment to malfunction.

Of course, it is possible that the control-compartment cooling fan will malfunction or fail. When such a failure occurs, the control devices may overheat and, then, fail. In a worst-case scenario, failure of the control devices will cause the oven to heat uncontrollably, resulting in an oven fire or similar catastrophic event.

In currently available ovens, particularly commercial ovens, "snap disc" thermostats are used within the control compartment. The snap disc thermostats are connected to heating elements. When the temperature in the control compartment exceeds a rating of the thermostat, the thermostat breaks a control circuit to disable the heating component. The excessive temperature condition is assumed to have occurred due to a failure of the cooling fan, which could be caused, for example, by a motor failure or a fan-blade blockage. While the use of snap-disc thermostats helps prevent uncontrollable heating of an oven, the thermostats have a number of deficiencies. One deficiency of snap disc thermostats is that they are imprecise and often constructed to loose tolerances. Sometimes, a thermostat rated for a certain temperature or temperature range will, in actuality, operate at a different temperature or temperature range. Thus, there are times when the thermostats will interrupt operation of an oven's heating element prematurely or when a cooling fan failure has not occurred.

Instead of using snap disc thermostats to sense the temperature of the control compartment and, indirectly, the operation of a cooling fan, embodiments of the invention utilize components and techniques to sense operation of the cooling fan directly and, more particularly, the operation of the cooling fan motor. For example, in one embodiment of the invention, the current in the cooling fan motor is sensed by a current sensor and the information from the sensor is analyzed by a processor, electronic controller, or similar device. By sensing the current of the cooling fan/component a more reliable method of control can be employed. If the cooling fan/component is dead, no current flows. The electronic controller then shuts off power to the heating circuit, leaving the rest of the appliance operational to run and cool down the remaining electrical components. If the cooling fan/component is stalled or blocked, a large current is sensed. The controller shuts down the heating circuit and leaves the rest of the appliance operational to run and cool down the remaining electrical components.

In addition to sensing the current of the cooling fan/component, other parameters may be sensed to detect a failure. For example, there are cooling fans that exist with a tachometer output. This tachometer output can also be used to determine if the cooling fan/component is operating within normal parameters or is outputting a non-compliant reading. If there is a non-compliant reading, the controller can again shut down the heating circuit and leave the rest of the appliance operational to run and cool down the remaining electrical components. Either of the two methods, 1) sensing the current or 2) the tachometer output, complies with the UL 197 regulations and eliminate the nuisance failures caused by errant temperatures on a snap disc thermostat. Further, error messages or error codes can be programmed into the controller such that a specific message about the cooling fan/component is displayed. The displayed message informs the operator of the failure and provides the operator better information to supply any service technician called to repair the malfunctioning oven.

Accordingly, in one embodiment, the invention provides a control system for control-compartment cooling fan of an oven. In one embodiment, the control system includes a sensor for sensing an operating condition of a motor of the cooling fan. The operating condition is selected from the group of a motor current and a motor RPM. A controller is communicatively connected to the sensor and is configured to receive the operating condition from the sensor, compare the operating condition to one or more predetermined tolerances and, when the operating condition exceeds at least one of the one or more predetermined tolerances, generate an interrupt command. A heating control element is communicatively connected to the controller and configured to interrupt operation of a heating element in response to receiving the interrupt command. The control system may also include a user interface communicatively connected to the controller.

In another embodiment, the invention provides a method of controlling an oven in response to the failure of a control-compartment, cooling fan of an oven. The method includes sensing an operating condition of a motor of the cooling fan with a sensor, the operating condition selected from the group of a motor current and a motor RPM; providing the operating condition to a controller communicatively connected to the sensor, the controller configured to compare the operating condition to one or more predetermined tolerances and, when the operating condition is outside at least one of the one or more predetermined tolerances, generating an interrupt command; and providing the interrupt command to a heating control element communicatively connected to the controller and configured to interrupt operation of a heating element in response to receiving the interrupt command. The method may also include providing a user interface communicatively connected to the controller.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
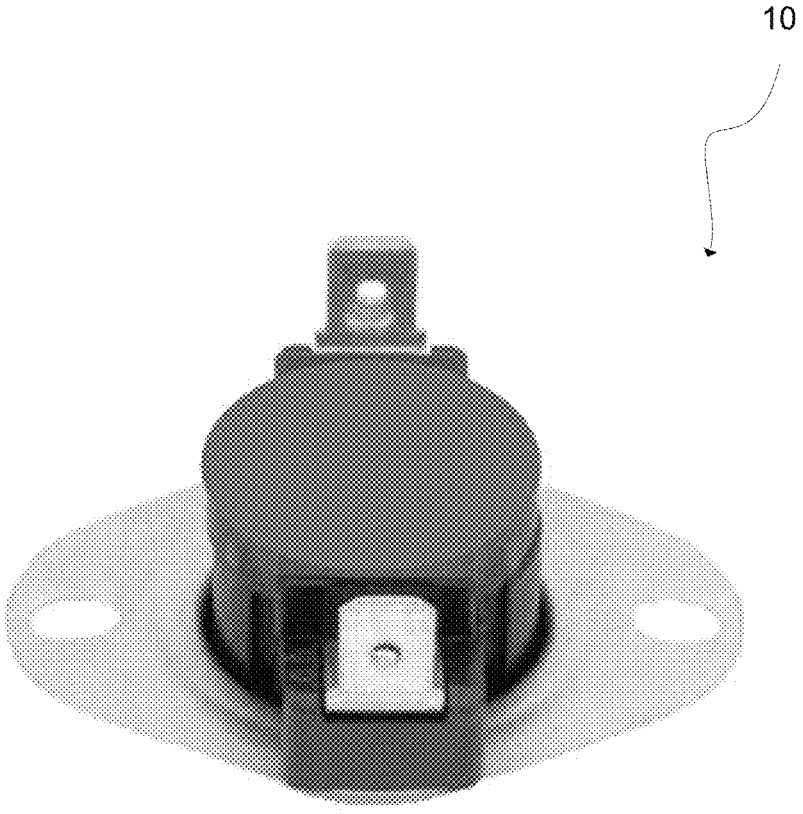
FIG. 1 PRIOR ART
FIG. 1 is an illustration of a prior-art snap disc thermostat.

FIG. 1 illustrates a prior-art snap disc thermostat 10 used to interrupt power to heating elements in the event that an ambient temperature is outside a designed tolerance of the thermostat. Generally, such a thermostat is connected in series with heating elements (such as electric heating elements or controllable gas valves) and a switch or switch-like component of the thermostat will open in response to excess temperature, thereby breaking the power circuit in which the heating elements are connected. When the operation of the heating elements is interrupted, no heat is generated. However, the remaining components of the oven control are not affected. Thus, other components of the oven may continue to run (for example, conveyors, fans, etc.) and will, over time, cool down.

Figure 2:
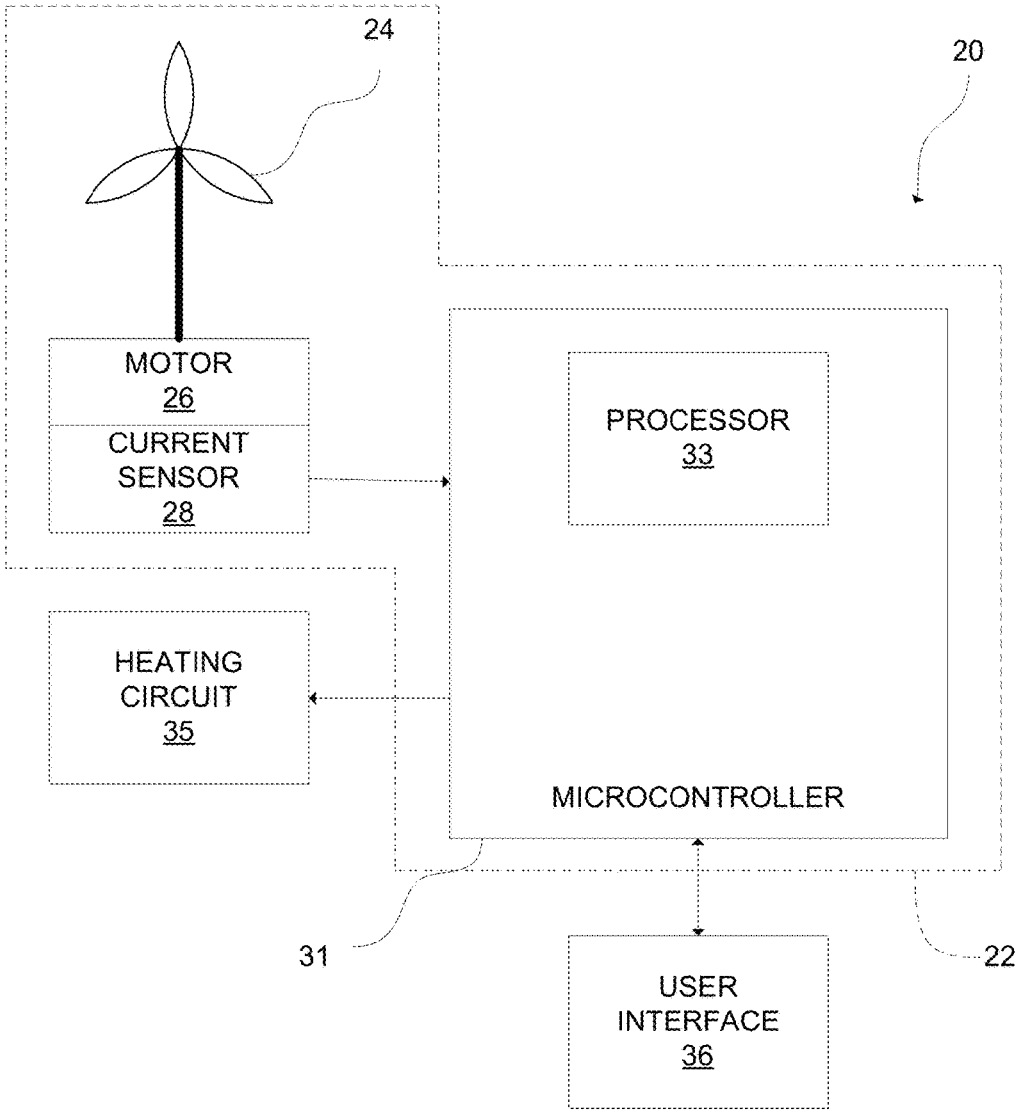
FIG. 2 is an illustration of exemplary control components used to sense operation of a cooling fan motor via a current sensor, process information from the current sensor in a controller (such as a microcontroller, microprocessor or similar device), and a user interface.

FIG. 2 illustrates a control system 20 having a control compartment 22. A fan 24 having an electric motor 26 is configured to cool the compartment (such as by exhausting air from the compartment). A current sensor 28 senses the amount of electric current through the motor 26. The current sensor 28 is connected to a controller 31 (which is shown as a microcontroller having a processor 33. The controller 31 is communicatively connected to a heating circuit 35. The heating circuit 35 contains a heating control element (such as a switch, circuit breaker, fuse, or a circuit that controls operation of an electrically-controllable gas valve). The heating control element is configured to interrupt operation of a heating element (such as a resistive coil, gas burner, etc.) in response to receiving an interrupt command (discussed in greater detail below). The controller 31 is also connected to a user interface 36. The user interface may include a display or other components for providing human-perceptible output to an operator and input components such as a keyboard, mouse, touch screen, or the like.

Figure 3:
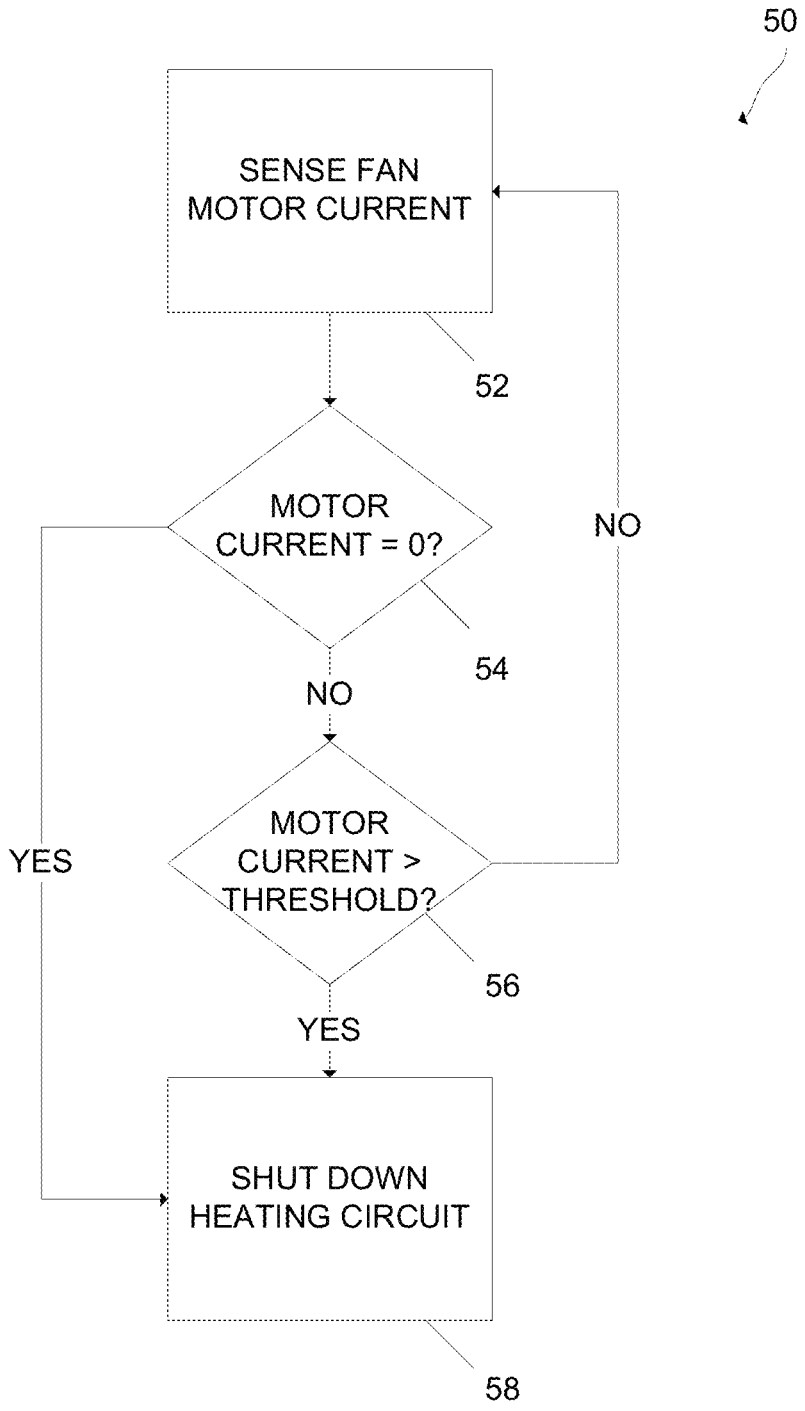
FIG. 3 is a flow chart of a control process carried out by the controller shown in FIG. 2.

FIG. 3 illustrates a process 50 carried out by the controller 31. In step 52, the controller 31 reads information from the current sensor 28. In step 54, the controller 31 determines if the current is zero (or substantially zero). If the current is zero, the controller assumes that the motor 26 is not operating and, as a consequence, no cooling of the control compartment is occurring. The controller 31 then generates an interrupt command to shut down the heating circuit of the oven and, more particularly, the heating control element (step 58). If the motor current is not equal to zero, the controller 31 determines whether the motor current has exceeded a predetermined threshold, which in one embodiment is a high-current threshold. A high-current condition will exist, if the motor is unable to rotate. Such a situation occurs, for example, when the fan blades of the fan are blocked. If the motor current exceeds the predetermined threshold, the controller 31 generates an interrupt command to shut down the heating circuit of the oven (step 58). The controller 31 may also generate an error message indicative of the current being out of tolerance. The error message may be sent to the user interface 36 where, for example, a message such as "ZERO CURRENT" or "HIGH CURRENT" may be displayed. Alternatively, a warning light or sound may be activated. If the sensed current is within normal operating limits, the controller 31 continues to monitor the motor current (returning to step 52).

Generally, a "tolerance" refers to a permitted variation in a characteristic. When a characteristic such as motor current (and as discussed below, RPM) is outside a predetermined tolerance (for example, exceeds a certain amount or is equal to zero), or is outside of a predetermined range, then a failure may be assumed to have occurred. For example, if the current RPM is greater than a minimum RPM and less than a maximum RPM, it may be assumed that the fan 24 is operating normally. If the RPM is less than a minimum RPM or greater than a maximum RPM, a failure may be assumed to have occurred.

Figure 4:
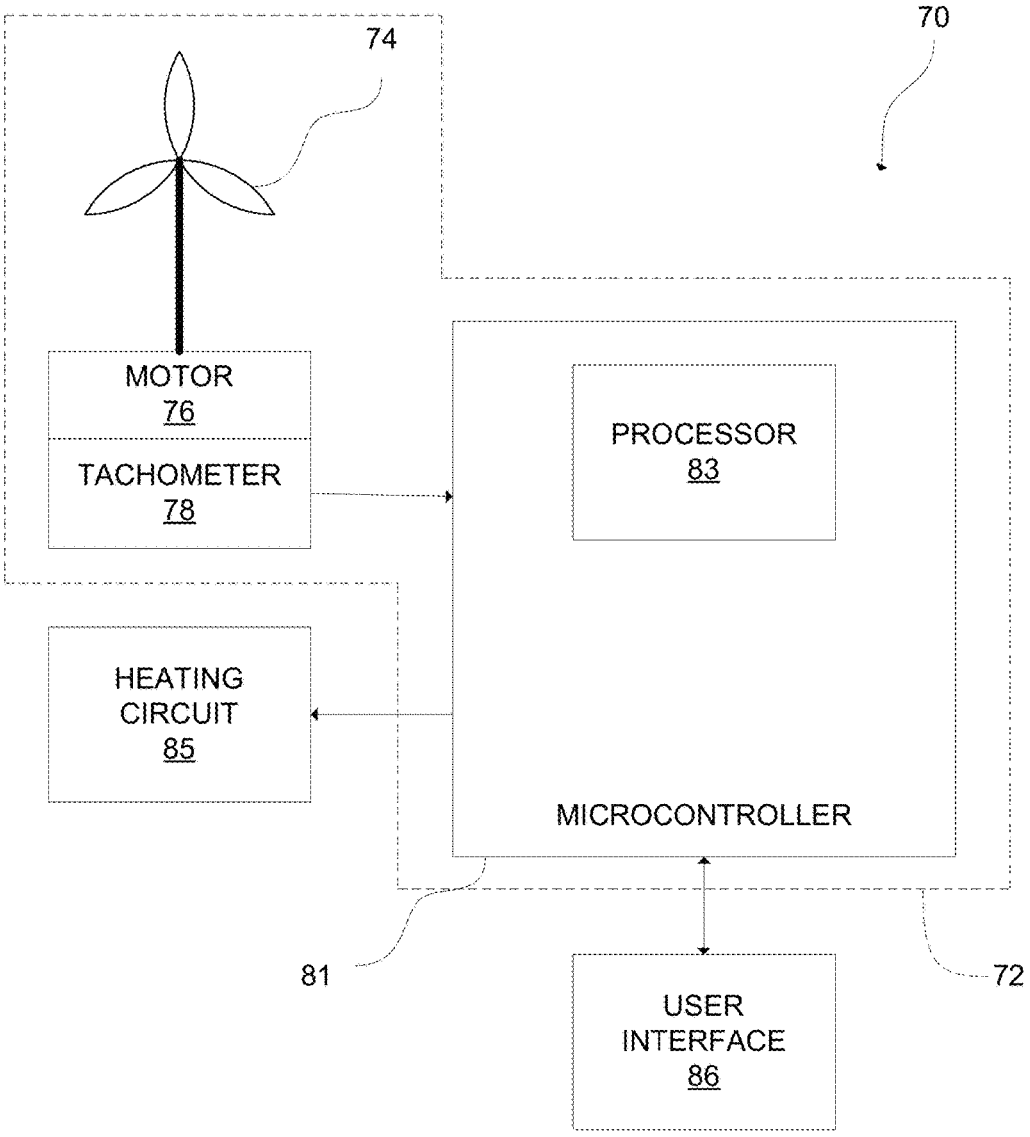
FIG. 4 is an illustration of an alternative embodiment of the invention in which a tachometer is used to sense operation of a cooling fan motor, particularly revolutions per minute of the fan motor, process information from the tachometer in a controller, and a user interface.

FIG. 4 illustrates an alternative embodiment of the control system shown in FIG. 2. FIG. 4 illustrates a control system 70 having a control compartment 72. A fan 74 having an electric motor 76 is configured to cool the compartment (such as by exhausting air from the compartment). A tachometer 78 senses the speed of the electric motor (e.g., the rotational speed of an output shaft of the motor). The tachometer 78 is connected to a controller 81 (similar to the controller 31) having a processor 83. The controller 81 is connected to a heating circuit 85. The heating circuit 85 contains a heating control element (such as a switch, circuit breaker, fuse, or a circuit that controls operation of an electrically-controllable gas valve). The heating control element is configured to interrupt operation of a heating element (such as a resistive coil, gas burner, etc.) in response to receiving an interrupt command. The controller 81 is also connected to a user interface 86 which may include a display or other components for providing human-perceptible output to an operator and input components such as a keyboard, mouse, touch screen, or the like.

Figure 5:
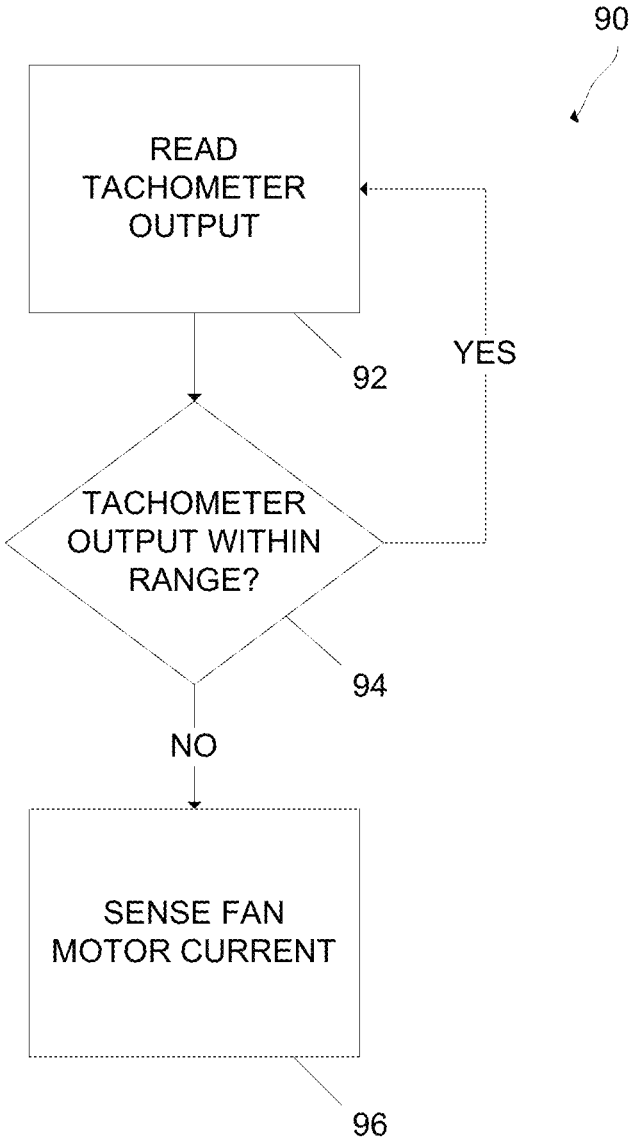
FIG. 5 is a flow chart of a control process carried out by the controller shown in FIG. 4.

FIG. 5 illustrates a process 90 carried out by the controller 81. In step 92, the controller reads information from the tachometer 78. In step 94, the controller 81 determines if the tachometer reading is within a predetermined range. In normal operation, the RPM of the motor should exceed a non-zero minimum speed but be less than a maximum speed (which may be represented, for example, as Max RPM>Current RPM>Min RPM). A low tachometer or RPM reading indicates that the motor has stopped or is operating so slowly as to be unable to provide sufficient cooling. A high tachometer or RPM reading may indicate that the motor has or will exceed the peak RPM for which the device is designed to operate without causing damage to the motor. If the tachometer reading falls outside the predetermined range, the controller 81 generates an interrupt command to shut down the heating circuit of the oven and, more particularly, the heating control element (step 96). The controller 81 may also generate an error message indicative of the RPM being out of tolerance. The error message may be sent to the user interface 86 where, for example, a message such as "LOW RPM" or "HIGH RPM" may be displayed. Alternatively, a warning light or sound may be activated. If the sensed RPM is within normal operating limits, the controller 81 continues to monitor the motor speed (returning to step 92).

Otherwise, the controller 81 continues to read information from the tachometer 78 (returning to step 92).

Thus, the invention provides, among other things, a control system for a control-compartment, cooling fan of an oven and a method of controlling a heating element of an oven in the event of a cooling fan failure. Various features and advantages of the invention are set forth in the following claims.

What is claimed is:

1. A control system for a control-compartment cooling fan of an oven, the control system comprising:

a sensor for sensing an operating condition of a motor of the cooling fan, wherein the operating condition is indicative of the speed of the cooling fan;

a controller communicatively connected to the sensor, the controller configured to receive the sensed operating condition level from the sensor, compare the sensed operating condition level to a predetermined operating range between a predetermined minimum operating condition level indicative of the speed of the cooling fan and a predetermined maximum operating condition level that is indicative of the speed of the cooling fan, generate an interrupt command when the sensed operating condition level is less than the predetermined minimum operating condition level that is indicative of a predetermined minimum cooling fan speed, and generate an interrupt command when the sensed operating condition level is greater than the predetermined maximum operating condition level that is indicative of a predetermined maximum cooling fan speed; and a heating control element communicatively connected to the controller and configured to interrupt operation of a heating element in response to receiving the interrupt command.

2. The control system as claimed in claim 1, further comprising a user interface communicatively connected to the controller.

3. The control system as claimed in claim 2, wherein the controller is configured to generate an error message for display on the user interface and wherein the error message is indicative of one of the sensed operating condition of the motor being less than the predetermined minimum operating condition level that is indicative of a minimum cooling fan speed or greater than the predetermined maximum operating condition level that is indicative of a maximum cooling fan speed.

4. The control system as claimed in claim 1, wherein the sensor comprises a tachometer and the operating condition comprises motor RPM.

5. A control system for a control-compartment cooling fan of an oven, the control system comprising:

a tachometer for sensing the RPM level of a motor of the cooling fan;

a controller communicatively connected to the tachometer, the controller configured to receive the sensed RPM level from the tachometer, generate a first interrupt command when the sensed RPM level is less than a predetermined minimum RPM level that is indicative of a predetermined minimum fan speed, and generate a second interrupt command when the sensed RPM level is greater than a predetermined maximum RPM level that is indicative of a predetermined maximum fan speed; and a heating control element communicatively connected to the controller and configured to interrupt operation of a heating element in response to receiving one of the first and the second interrupt commands.

6. The control system as claimed in claim 5, further comprising a user interface communicatively connected to the controller.

7. The control system as claimed in claim 6, wherein the controller is configured to generate an error message for display on the user interface and wherein the error message is indicative of the sensed RPM level being less than the predetermined minimum RPM level or greater than the predetermined maximum RPM level.

* * * * *